US007632059B2

(12) United States Patent
Tisenchek et al.

(10) Patent No.: US 7,632,059 B2
(45) Date of Patent: Dec. 15, 2009

(54) SYSTEMS AND METHODS FOR DETECTING UNDESIRABLE OPERATION OF A TURBINE

(75) Inventors: Nicholas A. Tisenchek, Clifton Park, NY (US); Edward Arthur Dewhurst, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 586 days.

(21) Appl. No.: 11/427,507

(22) Filed: Jun. 29, 2006

(65) Prior Publication Data

US 2008/0003095 A1 Jan. 3, 2008

(51) Int. Cl.
*F01D 3/02* (2006.01)

(52) U.S. Cl. ..... 415/1; 415/13; 701/100

(58) Field of Classification Search ..... None
See application file for complete search history.

(56) References Cited

U.S. PATENT DOCUMENTS 6,892,540 B1 * 5/2005 Tisenchek ..... 60/645
2003/0230088 A1 * 12/2003 Wolf ..... 60/651
2004/0101395 A1 * 5/2004 Tong et al. ..... 415/1

FOREIGN PATENT DOCUMENTS

JP 55035112 A * 3/1980

* cited by examiner

*Primary Examiner*—Richard Edgar
(74) *Attorney, Agent, or Firm*—Sutherland Asbill & Brennan LLP

(57) ABSTRACT

Systems and methods of detecting and correcting the undesirable operation of a turbine by monitoring one or more sensor devices, where each sensor device monitors one or more operating parameter values associated with various turbine components. If any of the sensor devices detects that a particular operating parameter associated with one or more turbine components is operating in a range of unacceptable risk, then corrective action is taken which may include opening and or closing one or more of the steam valves associated with an inlet pipe until that particular operating parameter of the turbine is no longer operating in a range of unacceptable risk.

17 Claims, 4 Drawing Sheets

SYSTEMS AND METHODS FOR DETECTING UNDESIRABLE OPERATION OF A TURBINE

FIELD OF THE INVENTION

The present invention relates generally to a system and method of determining undesirable operation in turbines or similar machinery.

BACKGROUND OF THE INVENTION

During the operation of a turbine, it is often necessary to monitor the operating parameters of the various components of the turbine. Limits exist for operating parameters to ensure proper operation of the turbine and its components. For example, in the operation of a steam turbine, it is necessary to set control limits for various operating parameters such as the steam pressure within the turbine.

Typically, a parameter may detect operation above a set limit for a short amount of time without adverse consequences; however, if the parameter exceeds the limit for long periods of time, the turbine may be damaged. Current methods for measuring parameter limit exceedance detect the moment in time in which a parameter limit is reached or exceeded. At which point a timer is then triggered to determine the duration for which the parameter exceeds the limit. Corrective action typically is taken only after the timer has run for a predetermined period while the parameter exceeds its magnitude limit.

However, some risk exists when operating a turbine in a mode of operation where the operating parameter limits have been exceeded which may occur regardless of whether or not the timer has run for a predetermined period. Such undesirable operation may cause the natural balancing for opposing thrust forces of opposing turbines to become unbalanced. Such unbalance of thrust forces of opposing turbines may cause high loads on the turbine components, which could lead to excessive wear or failure of one or more turbine components. Therefore, there exist a need in the art for systems and methods to preemptively or proactively prevent turbine component damage and/or failures due to the unbalancing of opposing thrust forces of opposing turbines.

SUMMARY OF THE INVENTION

According to an embodiment of the invention, there is disclosed a method of detecting and correcting the undesirable operation of a turbine system that includes monitoring one or more sensor devices, where at least one sensor device is associated with at least one operating parameter associated with the high pressure turbine bowl pressure and at least one other sensor is associated with at least one operating parameter relating to the intermediate pressure turbine bowl pressure. The method further includes determining if at least one operating parameter relating to the high pressure turbine bowl pressure and at least one operating parameter relating to the intermediate pressure turbine bowl pressure are within a range of unacceptable risk. The method also includes continuously running back the load reference by adjusting at least one steam value associated with an inlet pipe upon determining that at least one operating parameter relating to the high pressure turbine bowl pressure and at least one operating parameter relating to the intermediate pressure turbine bowl pressure are within a range of unacceptable risk.

In accordance with one aspect of the invention, the method further includes monitoring the thrust bearing metal temperature with a thrust bearing metal temperature sensor. According to another aspect of the invention, the method further includes monitoring the thrust bearing metal temperature with a thrust bearing metal temperature sensor and determining a rise in the thrust bearing metal temperature to a temperature range associated with unacceptable risk; and continuously running back the load reference until the thrust bearing metal temperature decreases below the temperature range associated with unacceptable risk. In accordance with yet another aspect of the invention, the range of unacceptable risk occurs when the high pressure turbine bowl pressure is greater than a predetermined percentage of a rated pressure associated with the high pressure turbine bowl while the intermediate pressure turbine bowl pressure is less than a predetermined percentage of a rated pressure associated with intermediate pressure turbine bowl.

According to yet another aspect of the invention, the method further includes taking corrective action that includes at least one of setting off an alarm, transmitting an alarm signal, closing the steam valves, altering the temperature of the steam entering the steam turbines, altering the pressure of the steam entering the steam turbines, and shutting the system off altogether. In accordance with another aspect of the invention, the method further includes recording instances where at least one of the sensor devices detects one or more turbine components operating in a range of unacceptable risk.

According to another embodiment of the invention, there is disclosed a method of detecting and correcting a thrust overload of a turbine that includes monitoring one or more steam pressure sensors, where at least one steam pressure sensor is measuring a high pressure turbine bowl pressure value. The method also includes determining if the high pressure turbine bowl pressure value is within a range of unacceptable risk and taking corrective action when the high pressure turbine bowl pressure value is within the range of unacceptable risk.

In accordance with one aspect of the invention, the range of unacceptable risk is greater than a predetermined percentage of a rated pressure value associated with the high pressure turbine bowl. According to another aspect of the invention, the method may further include determining if an intermediate pressure turbine bowl pressure value is operating lower than a predetermined percentage of a rated pressure value associated with the intermediate pressure turbine bowl. In accordance with yet another aspect of the invention, taking corrective action includes running back a load reference at a predetermined rate. According to yet another aspect of the invention, the method may further include monitoring at least one thrust bearing metal temperature sensor and shutting down the turbine when the at least one thrust bearing metal temperature sensor detects an operating temperature above a predefined temperature.

In accordance with another aspect of the invention, taking corrective action includes adjusting at least one steam value associated with an inlet pipe. According to yet another aspect of the invention, taking corrective action includes at least one of setting off an alarm, transmitting an alarm signal, closing the steam valves, altering the temperature of the steam entering the steam turbines, altering the pressure of the steam entering the steam turbines, and shutting the system off altogether. In accordance with another aspect of the invention, the method may include recording instances when at least one of the sensor devices detects one or more turbine components operating in a range of unacceptable risk.

According to yet another embodiment of the invention, there is disclosed a system for detecting and correcting the undesirable operation of a turbine that includes one or more sensor devices in communication with a control unit, where at least one sensor device is associated with at least one operating parameter associated with the high pressure turbine bowl pressure and at least one other sensor is associated with at least one operating parameter relating to the intermediate pressure turbine bowl pressure. The control unit includes a processor that executes software instructions for monitoring the sensor devices and determining if at least one operating parameter relating to the high pressure turbine bowl pressure and at least one operating parameter relating to the intermediate pressure turbine bowl pressure are within a range of unacceptable risk. Further, based at least in part on that determination, the processor of the control unit continuously running back the load reference by adjusting at least one steam value associated with an inlet pipe upon determining that at least one operating parameter relating to the high pressure turbine bowl pressure and at least one operating parameter relating to the intermediate pressure turbine bowl pressure are within a range of unacceptable risk.

In accordance with one aspect of the invention, the processor executes additional software instructions for monitoring the thrust bearing metal temperature with a thrust bearing metal temperature sensor. According to another aspect of the invention, the processor executes additional software instructions for monitoring the thrust bearing metal temperature with a thrust bearing metal temperature sensor, determining a rise in the thrust bearing metal temperature to a temperature range associated with unacceptable risk and continuously running back the load reference until the thrust bearing metal temperature decreases below the temperature range associated with unacceptable risk. In accordance with yet another aspect of the invention, the range of unacceptable risk occurs when the high pressure turbine bowl pressure is greater than a predetermined percentage of a rated pressure associated with the high pressure turbine bowl while the intermediate pressure turbine bowl pressure is less than a predetermined percentage of a rated pressure associated with intermediate pressure turbine bowl.

According to yet another aspect of the invention, the processor executes additional software instructions for taking corrective action includes at least one of setting off an alarm, transmitting an alarm signal, closing the steam valves, altering the temperature of the steam entering the steam turbines, altering the pressure of the steam entering the steam turbines, and shutting the system off altogether. In accordance with yet another aspect of the invention, the processor executes additional software instructions for recording instances in a memory location associated with the control unit whenever at least one of the sensor devices detects one or more turbine components operating in a range of unacceptable risk.

BRIEF DESCRIPTION OF DRAWINGS

Figure 1:
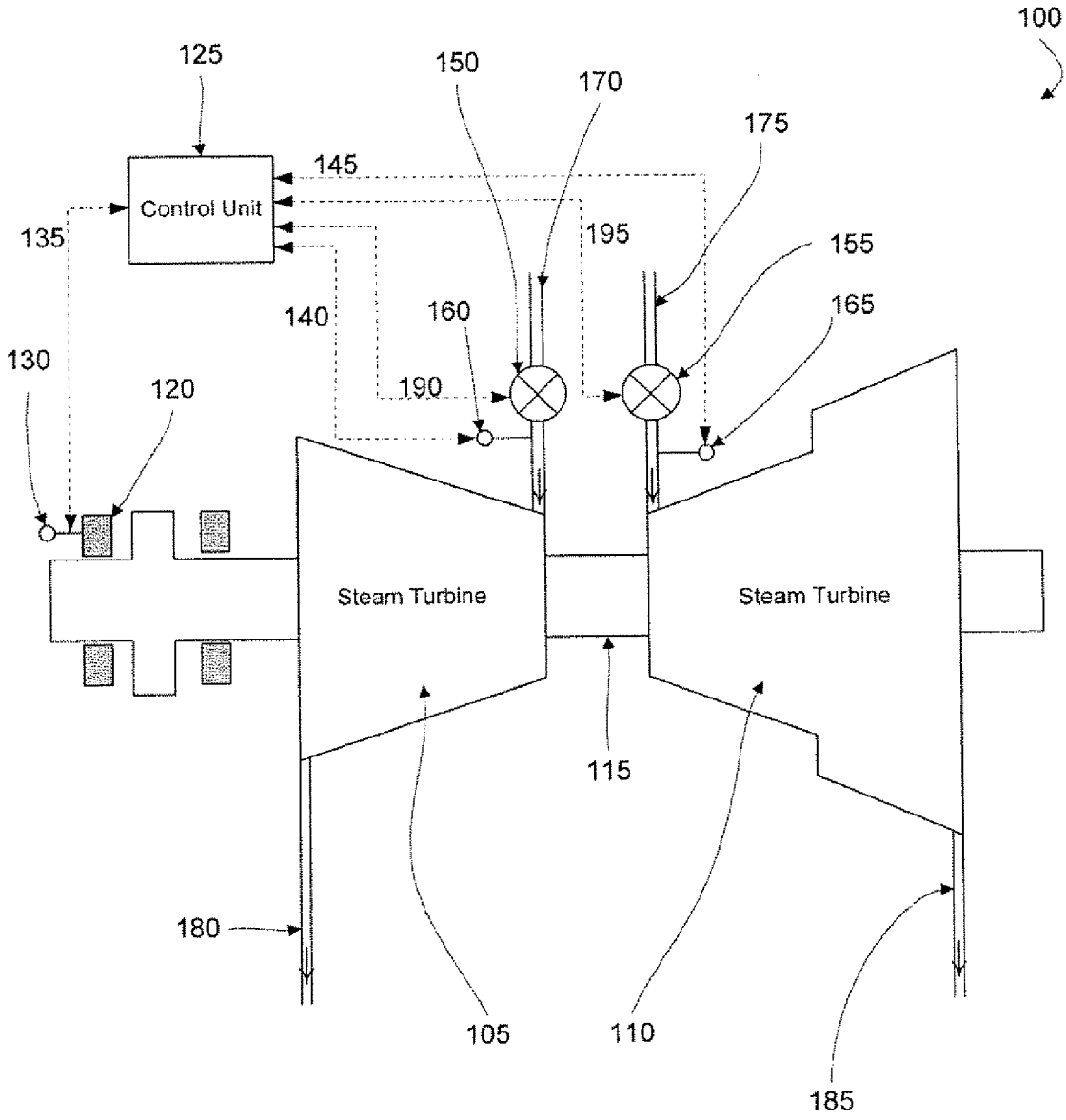

Having thus described the invention in general terms, reference will now be made to the accompanying drawings, which are not necessarily drawn to scale, and wherein:

FIG. 1 is a schematic diagram of a steam turbine system implementing a method to detect undesirable operation of turbine components, in accordance with an exemplary embodiment of the invention.

Figure 2:
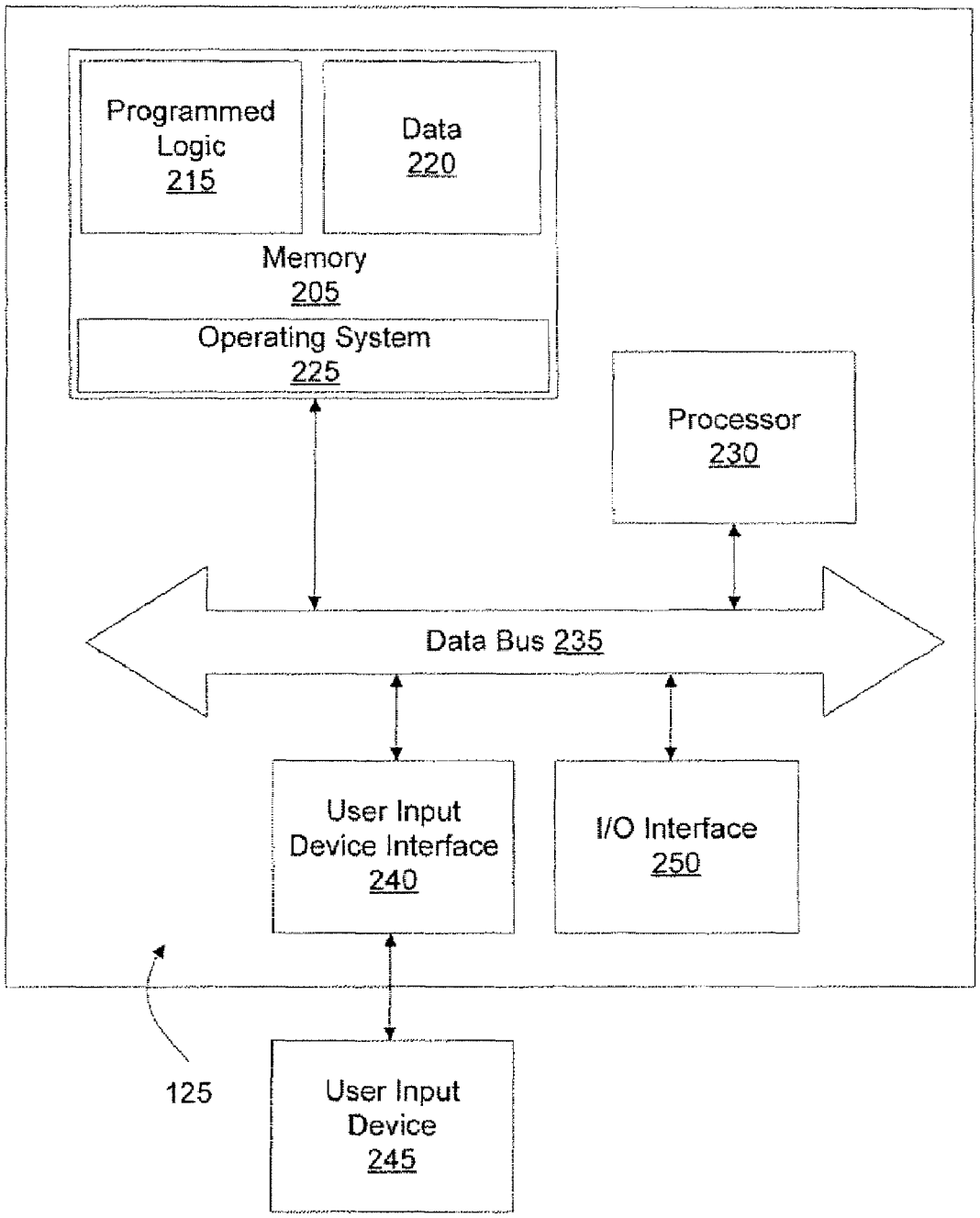

FIG. 2 is a block diagram of the control unit used in a method to detect undesirable operation of turbine components, in accordance with an exemplary embodiment of the invention.

Figure 3:
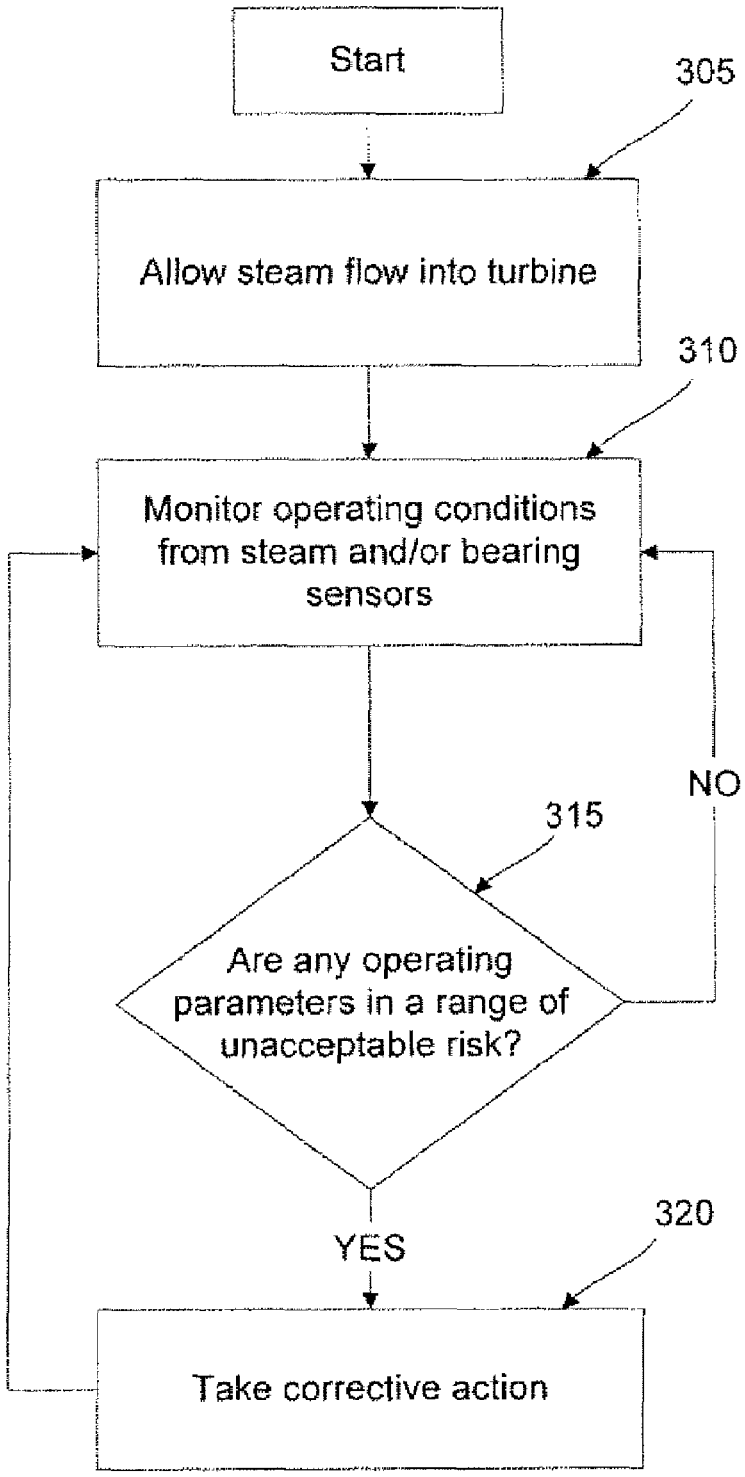

FIG. 3 is an exemplary flowchart of the control logic of a control unit implementing a method to detect undesirable operation of turbine components, in accordance with an exemplary embodiment of the invention.

Figure 4:
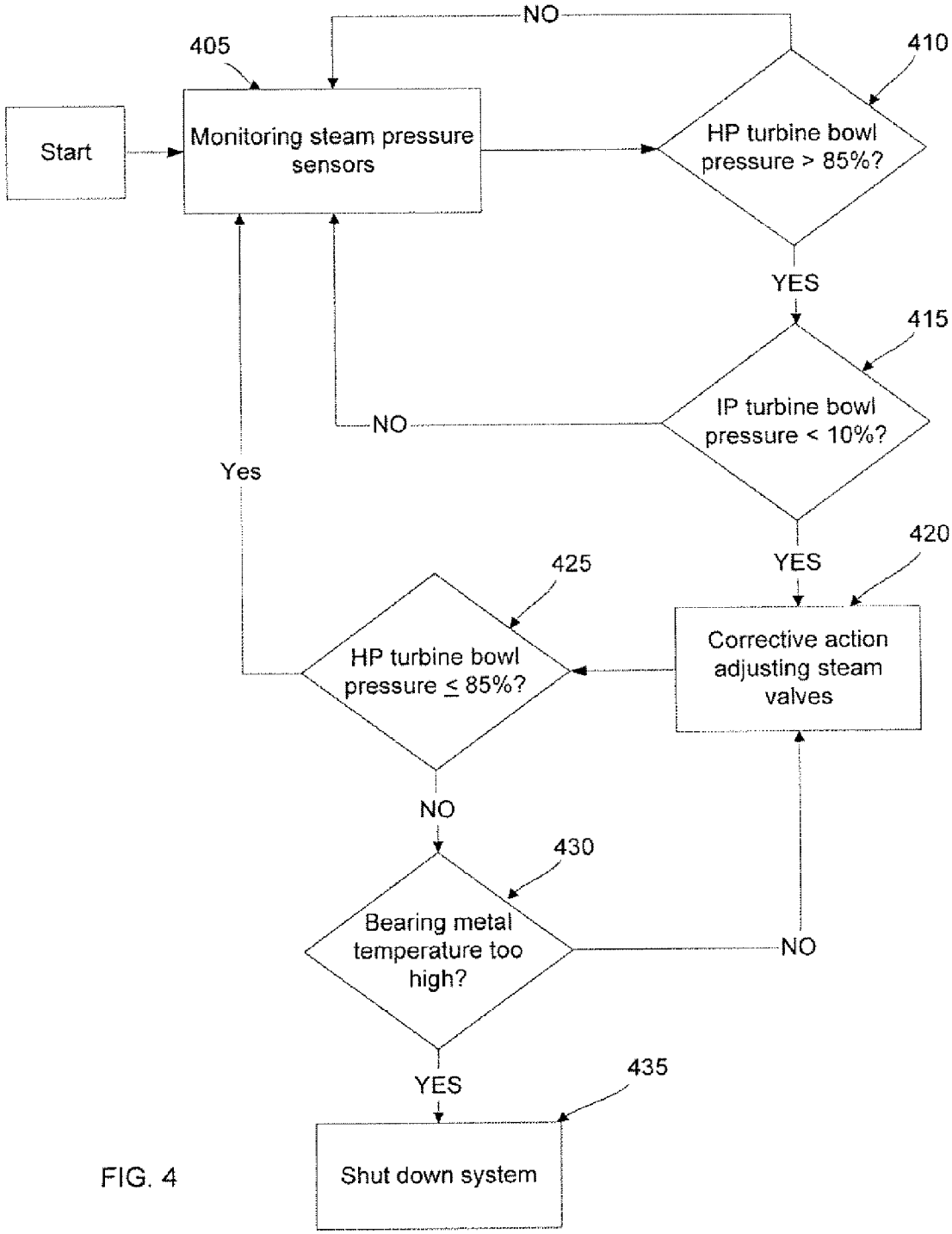

FIG. 4 is an exemplary flowchart of the control logic of a control unit implementing a method to take corrective action when a thrust overload condition exits, in accordance with an exemplary embodiment of the invention.

DETAILED DESCRIPTION OF THE INVENTION

The invention is directed to systems and methods that utilize measured operation parameters to determine if a turbine is entering a region of undesired operation. If an undesired condition exists, the turbine control system initiates corrective action to avoid damage to parts. In an exemplary embodiment of the invention, steam pressure and bearing metal temperature sensors are used to monitor the operating conditions of a steam turbine through the use of a steam turbine control system programmed with steam turbine control system protection logic. Based on the information provided by the sensors, the steam turbine control system may initiate preemptive action to prevent excessive wear or damage to steam turbine components that typically occurs when a steam turbine component(s) has exceeded its threshold limit. More particularly, the steam turbine control system will detect when the steam turbine is entering an operational area of unacceptable risk (e.g., an undesirable flow unbalance mode of operation), which occurs before reaching a set limit associated with that particular steam turbine component. The control unit of the steam turbine control system will take the necessary measures to remove the steam turbine from this region of high risk operation before it exceeds the region of unacceptable risk and reaches a set limit threshold associated with that particular steam turbine component, thereby avoiding excessive wear to turbine components or turbine failure.

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

The present invention is described below with reference to block diagrams of systems, methods, apparatuses and computer program products according to an embodiment of the invention. It will be understood that each block of the block diagrams, and combinations of blocks in the block diagrams, respectively, can be implemented by computer program instructions. These computer program instructions may be loaded onto a general purpose computer, special purpose computer, or other programmable data processing apparatus to produce a machine, such that the instructions which execute on the computer or other programmable data processing apparatus create means for implementing the functionality of each block of the block diagrams, or combinations of blocks in the block diagrams discussed in detail in the descriptions below.

These computer program instructions may also be stored in a computer-readable memory that can direct a computer or other programmable data processing apparatus to function in a particular manner, such that the instructions stored in the computer-readable memory produce an article of manufacture including instruction means that implement the function specified in the block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide steps for implementing the functions specified in the block or blocks.

Accordingly, blocks of the block diagrams support combinations of means for performing the specified functions, combinations of steps for performing the specified functions and program instruction means for performing the specified functions. It will also be understood that each block of the block diagrams, and combinations of blocks in the block diagrams, can be implemented by special purpose hardware-based computer systems that perform the specified functions or steps, or combinations of special purpose hardware and computer instructions.

The inventions may be implemented through an application program running on an operating system of a computer. The inventions also may be practiced with other computer system configurations, including hand-held devices, multiprocessor systems, microprocessor based or programmable consumer electronics, mini-computers, mainframe computers, etc.

Application programs that are components of the invention may include routines, programs, components, data structures, etc. that implement certain abstract data types, perform certain tasks, actions, or tasks. In a distributed computing environment, the application program (in whole or in part) may be located in local memory, or in other storage. In addition, or in the alternative, the application program (in whole or in part) may be located in remote memory or in storage to allow for the practice of the inventions where tasks are performed by remote processing devices linked through a communications network. Exemplary embodiments of the present invention will hereinafter be described with reference to the figures, in which like numerals indicate like elements throughout the several drawings.

FIG. 1 is a schematic diagram of a steam turbine system 100 implementing a method to detect undesirable operation in accordance with an exemplary embodiment of the invention. Use of the present invention in the steam turbine system 100 shown in FIG. 1 is only described as one representative example of an application of the present invention. It will be understood by those skilled in the art that the present invention can be implemented in any similar system in which the system parameters have magnitude limits and the magnitudes of the parameters vary over time. These systems include, but are not limited to, industrial machinery, steam turbines, gas turbines, other combustion systems, and hydraulic systems.

According to FIG. 1, steam turbines 105 and 110 are shown in the steam turbine system 100. In the exemplary embodiment of FIG. 1, steam turbine 105 is the high pressure end and steam turbine 110 is the intermediate (or low) pressure end. In typical operation, steam enters the steam turbines 105 and 110 by way of steam input pipes 170 and 175, respectively. The flow of steam through the steam inlet pipes 170 and 175 is controlled by steam valves 150 and 155, respectively. If the steam valves 150 and 155 are open, then steam will be allowed to flow through the steam inlet pipes 170 and 175. Alternatively, if the steam valves 150 and 155 are closed, steam will not be permitted to flow through the steam inlet pipes 170 and 175 into the steam turbines 105 and 110. As is appreciable by one of ordinary skill in the art, the valves 150 and 155 may be partially opened at various increments, which may vary the rate of steam flow into the steam turbines 105 and 110. Further, steam exits the sections 105 and 110 by way of steam exit pipes 180 and 185, respectively.

Sensor devices may be used to monitor various parameters of the steam turbine components and its operation. The exemplary sensor devices shown in FIG. 1 are steam pressure sensors 160 and 165, which monitor the pressure of the steam entering the turbines 105 and 110, and metal temperature sensors 130, which measure the temperature of the thrust bearing(s) 120 connected to the turbine rotor 115. It will be understood by those skilled in the art that other operating parameters of the steam turbine 100 could be monitored by other sensor devices including, but not limited to, steam temperature, other bearings used in the turbine system 100 or any other variable parameter on which a limit may be placed.

A control unit 125 receives operating parameter data from the sensor devices (e.g., 130, 160 and 165) via monitor lines 135, 140 and/or 145 and may take corrective action if the operating parameter data detected indicates that the parameters are at undesirable operation values associated with unacceptable risk for a particular steam turbine component (s). Specifically, in the exemplary embodiment of FIG. 1, the control unit 125 monitors operation parameters via steam pressure sensors 160 and 165 and metal temperature sensors 130 over monitor lines 135, 140 and 145 and compares the operating parameters to allowable limits stored in memory. If the operating parameters are entering (or, in an alternative embodiment of the invention, approaching) the undesirable operating range associated with unacceptable risk, the control unit 125 opens or closes the steam valves 150 and 155 via the control signal lines 190 or 195 until the operating parameters return to being within a more desirable range. The specific operation of the control unit 125 in an exemplary embodiment of the invention are described in further detail with regard to FIGS. 2 and 3 below.

According to an exemplary embodiment of the invention, an undesirable condition that may be detected by the control unit 125 is an unbalanced thrust condition such as a thrust overload. A thrust overload may occur due to high flows in the high pressure steam turbine 105 and very low or no flow through the intermediate pressure turbine 110. For example, if the turbine system 100 is operating at full load (full flow) and the steam valve 150 closed and/or a intermediate pressure turbine bypass opens and flow is diverted around the intermediate pressure turbine 110, the intermediate pressure turbine bowl pressure will drop while the high pressure steam turbine bowl pressure stays at or near rated pressure. In the thrust overload condition, the thrust being generated by the high pressure steam turbine 105 is not being balanced by the intermediate pressure turbine 110, thereby overloading the thrust bearing 120.

The control unit 125 may detect such a thrust overload condition by use of sensor devices such as the steam pressure sensors 160 and 165 measuring the high pressure turbine bowl pressure and the intermediate pressure turbine bowl pressure, as well as the metal temperature sensor 130 measuring the overloading of the thrust bearing 120. The thrust bearing metal temperature monitored by the metal temperature sensor 130 is an added indication that there may be a problem with the thrust bearing 120 as a result of a thrust unbalanced state.

In an exemplary embodiment of the invention, the control unit 125 may detect thrust overload, as defined when the high pressure turbine bowl pressure is greater than a predetermined percentage of the rated pressure. For example, the predetermined percentage of the high pressure turbine bowl pressure may be 85% of its rated pressure and the intermediate pressure turbine bowl pressure may be less than 10% of its rated pressure. In alternative embodiments of the invention, various predetermined percentages of rated pressure may be used. In an exemplary embodiment of the invention, 10% is selected for the intermediate pressure turbine bowl pressure as an indicator that there is low flow (or no appreciable flow)

passing through the intermediate turbine 110. In the exemplary embodiment of the invention, very low or no intermediate pressure turbine flow while the high pressure turbine bowl pressure is at 85% of its rated pressure or below is generally acceptable because below 85%, the high pressure turbine 105 does not generate enough thrust to overload the thrust bearing 120.

If a thrust overload condition is detected, the control unit 125 then takes the appropriate corrective measures to get out of a high thrust condition. In an exemplary embodiment of the invention, the control unit 125 adjusts the steam valves 150 and 155 to continuously runback the load reference until the high pressure turbine bowl pressure drops below 85% of rated pressure. In an exemplary embodiment of the invention the control unit 125 may continuously runback the load reference 20% per minute until such pressure drop is achieved. However, through use of the metal temperature sensor 130, while the control unit 125 continues to detect the high thrust condition, the control unit 125 monitors the thrust bearing metal temperature. In an exemplary embodiment of the invention, if the thrust bearing metal temperature rises to a temperature range associated with unacceptable risk to the thrust bearing or other components of the turbine system 100, then the turbine system 100 is tripped or shut down. Therefore, in such an exemplary embodiment, a system shutdown will occur if a thrust unbalanced condition and an unacceptable thrust bearing temperature thrust are detected.

FIG. 2 is a block diagram of a control unit 125 used in a method to detect undesirable operation of turbine components, in accordance with an exemplary embodiment of the invention. The control unit 125 includes a memory 205 that stores programmed logic 215 (e.g., software) in accordance with the present invention. The memory 205 also includes allowable limit data 220 (e.g., the rated limits of operation of a component, preferred ranges of operation, and/or operational ranges associated with unacceptable risk, etc.) utilized in the operation of the present invention and an operating system 225. A processor 230 utilizes the operating system 225 to execute the programmed logic 215, and in doing so, also utilizes the allowable limit data 220. A data bus 235 provides communication between the memory 205 and the processor 230.

Users communicate/control the control unit 125 via a user input device interface 240 in communication with user input device(s) 245 such as a keyboard, mouse, control panel, or any other devices capable of communicating digital data to the control unit 125 for configuration and/or control of the various components of the turbine system controlled by the control unit 125. The control unit 125 is in communication with the valves associated with the steam turbines, sensor devices (e.g., pressure or bearing temperature sensors) and, in some cases, external devices associated with the steam turbine system, via an I/O Interface 250. In an exemplary embodiment of the invention, the control unit 125 may be co-located or even integrated with a steam turbine system, though alternatively, it may be located remotely with respect to the steam turbine system. Further the control unit 125 and the programmed logic 215 implemented thereby may comprise software, hardware, firmware or any combination thereof.

FIG. 3 is an exemplary flowchart of the control logic of a control unit implementing a method to detect undesirable operation, in accordance with an exemplary embodiment of the invention. At step 305, the control unit opens the steam valves, allowing steam to flow into the steam turbines sections through the steam input pipes. Next, at step 310, the sensor devices, which may be steam pressure sensor devices, thrust bearing metal temperature sensor devices, a combination of the two, or other devices that monitor a component or particular operation of the steam turbine, continuously monitor the operating parameters of the steam turbine system. According to an aspect of the present invention, the sensor devices may detect allowable limit data and transmit the data to the control unit. Thus, the control unit continuously monitors the operating parameters, as indicated by step 310. This allowable limit data may be, for example, actual measurements of an operational parameter or an absolute value representative of the change in an operational parameter. It will be appreciated by those of ordinary skill in the art that other forms of data associated with an operating parameter may be provided by the sensor device to the control unit.

At step 315, the control unit determines whether the operating parameters of the steam turbines have entered a range of unacceptable risk. If the steam turbines are operating within acceptable limits, then the control unit returns to its monitoring of operating parameters at step 310. If, however, the steam turbines are not operating within acceptable limits and have entered a range of operation that is associated with a particular risk level that is unacceptable, then the control unit will take corrective action, as indicated by step 320. According to an embodiment of the present invention, this corrective action in step 320 may be, for example, adjusting the steam valves associated with the inlet pipes. Control actions may include, but are not limited to setting off an alarm, transmitting an alarm signal, closing the steam valves, altering the temperature of the steam entering the steam turbines, altering the pressure of the steam entering the steam turbines, or shutting the system off altogether. Additionally, any triggered alarms or instances of a system operating outside of acceptable limits may be recorded in the memory of the control system. In other words, where at least one of the sensor devices detects one or more turbine components operating in a range of unacceptable risk such detected data may be recorded and stored in a database for future analysis.

FIG. 4 is an exemplary flowchart of the control logic of a control unit implementing a method to take corrective action when a thrust overload condition exits, in accordance with an exemplary embodiment of the invention. One example of an undesirable condition that may be detected by the control unit is an unbalanced thrust condition such as a thrust overload. In the thrust overload condition, the thrust being generated by the high pressure steam turbine is not being balanced by the intermediate pressure turbine, thereby overloading the thrust bearing.

In an exemplary embodiment of the invention, the control unit invokes step 405 to monitor the sensor devices such as the steam pressure sensors and measure the high pressure turbine bowl pressure and the intermediate pressure turbine bowl pressure, as well as the metal temperature sensor measuring the overloading of the thrust bearing. Next, the control unit invokes step 410 to determine if the high pressure turbine bowl pressure is greater than a predetermined percentage of the rated pressure. For instance, in the exemplary embodiment of FIG. 4, the predetermined percentage of the high pressure turbine bowl pressure may be 85% of its rated pressure. If not, the control unit continues to monitor the sensor devices at step 405. If the high pressure turbine bowl pressure is greater than 85% of its rated pressure, then step 415 is invoked to determine if the intermediate pressure turbine bowl pressure is less than a predetermined percentage of the rated pressure. For instance, in the exemplary embodiment of FIG. 4, the intermediate pressure turbine bowl pressure may be less than 10% of its rated pressure.

In an exemplary embodiment of the invention, 10% is selected for the intermediate pressure turbine bowl pressure as an indicator that there is low flow (or no appreciable flow) passing through the intermediate turbine. If intermediate pressure turbine bowl pressure is not less than 10% of its rated pressure, then the control unit continues to monitor the sensor devices at step 405. In the exemplary embodiment of the invention, very low or no intermediate pressure turbine flow while the high pressure turbine bowl pressure is at 85% of its rated pressure or below is acceptable because below 85% the high pressure turbine does not generate enough thrust to overload the thrust bearing. If the intermediate pressure turbine bowl pressure is less than 10% of its rated pressure then a thrust overload condition is detected and step 420 is invoked. In alternative embodiments of the invention, the percentages associated with the rated pressure values of the high pressure turbine bowl and the intermediate pressure turbine bowl may vary. Further, in other embodiments of the invention, the percentages associated with the rated pressure values of the high pressure turbine bowl and the intermediate pressure turbine bowl may be related (e.g., inversely proportional, etc.)

At step 420, the control unit begins to take the appropriate corrective measures to get out of a high trust condition. In an exemplary embodiment of the invention, the control unit adjusts the steam valves to continuously runback the load reference. In the exemplary embodiment of the invention, the control unit may runback the load reference at 20% per minute, though alternative runback rates may be implemented in other embodiments. Also at step 420, while the control unit continues to detect the high thrust condition, the control unit monitors the thrust bearing metal temperature through use of the metal temperature sensor as an added indicator that there is a problem with the thrust bearing as a result of a thrust unbalanced state.

Step 425 is then invoked to determine if the high pressure turbine bowl pressure drops below 85% of rated pressure. If the high pressure turbine bowl pressure drops below 85% of rated pressure, then the thrust overload condition has been alleviated and the control unit continues to monitor for the next undesirable condition at step 405. If the high pressure turbine bowl pressure does not drop below 85% of rated pressure, then the control unit continues to continuously runback the load reference (e.g., 20% per minute) until such pressure drop is achieved and invokes step 430 to determine if the thrust bearing metal temperature rises to a temperature range associated with unacceptable risk to the thrust bearing or other components of the turbine system. If such a temperature range has not been reached then the control unit continues to runback the load reference at step 420. If the thrust bearing metal temperature does rise to a temperature range associated with unacceptable risk then the turbine system is tripped or shut down at step 435. Therefore, in such an exemplary embodiment, a system shutdown will occur if a thrust unbalanced condition and an unacceptable thrust bearing temperature thrust are detected.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method of detecting and correcting the undesirable operation of a turbine system comprising:

monitoring a plurality of sensor devices, wherein at least one sensor device is associated with at least one operating parameter associated with the high pressure turbine bowl pressure and at least one other sensor is associated with at least one operating parameter relating to the intermediate pressure turbine bowl pressure;

monitoring the thrust bearing metal temperature with a thrust bearing metal temperature sensor;

determining if the at least one operating parameter relating to the high pressure turbine bowl pressure and the at least one operating parameter relating to the intermediate pressure turbine bowl pressure are within a range of unacceptable risk; and based at least in part upon the step of determining, continuously running back the load reference by adjusting at least one steam valve associated with an inlet pipe upon determining that the at least one operating parameter relating to the high pressure turbine bowl pressure and the at least one operating parameter relating to the intermediate pressure turbine bowl pressure are within a range of unacceptable risk.

2. The method of claim 1, further comprising determining a rise in the thrust bearing metal temperature to a temperature range associated with unacceptable risk; and continuously running back the load reference until the thrust bearing metal temperature decreases below the temperature range associated with unacceptable risk.

3. The method of claim 1, wherein the range of unacceptable risk occurs when the high pressure turbine bowl pressure is greater than a predetermined percentage of a rated pressure associated with the high pressure turbine bowl while the intermediate pressure turbine bowl pressure is less than a predetermined percentage of a rated pressure associated with intermediate pressure turbine bowl.

4. The method of claim 1, further comprising taking corrective action that includes at least one of: setting off an alarm, transmitting an alarm signal, closing the at least one steam valve, altering a temperature of the steam entering the steam turbines, altering a pressure of the steam entering the steam turbines, or shutting the turbine system off altogether.

5. The method of claim 1, further comprising recording instances where at least one of the sensor devices detects one or more turbine components operating in a range of unacceptable risk.

6. A method of detecting and correcting a thrust overload of a turbine comprising:

monitoring a plurality of steam pressure sensors, wherein at least one steam pressure sensor is measuring a high pressure turbine bowl pressure value;

monitoring at least one thrust bearing metal temperature sensor;

determining if the high pressure turbine bowl pressure value is within a range of unacceptable risk; and taking corrective action upon determining that the high pressure turbine bowl pressure value is within the range of unacceptable risk; and shutting down the turbine when the at least one thrust bearing metal temperature sensor detects an operating temperature above a predefined temperature.

7. The method of claim 6, wherein the range of unacceptable risk is greater than a predetermined percentage of a rated pressure value associated with the high pressure turbine bowl.

8. The method of claim 6, further comprising determining if an intermediate pressure turbine bowl pressure value is operating lower than a predetermined percentage of a rated pressure value associated with the intermediate pressure turbine bowl.

9. The method of claim 6, wherein taking corrective action includes running back a load reference at a predetermined rate.

10. The method of claim 6, wherein taking corrective action includes adjusting at least one steam valve associated with an inlet pipe.

11. The method of claim 6, wherein taking corrective action includes at least one of: setting off an alarm, transmitting an alarm signal, closing the at least one steam valve, altering a temperature of the steam entering the steam turbines, altering a pressure of the steam entering the steam turbines, or shutting the turbine system off altogether.

12. The method of claim 6, further comprising recording instances when at least one of the sensor devices detects one or more turbine components operating in a range of unacceptable risk.

13. A system for detecting and correcting the undesirable operation of a turbine comprising:

a plurality of sensor devices in communication with a control unit, wherein at least one sensor device is associated with at least one operating parameter associated with the high pressure turbine bowl pressure and at least one other sensor is associated with at least one operating parameter relating to the intermediate pressure turbine bowl pressure; and wherein the control unit includes a processor that executes software instructions for:

monitoring the plurality of sensor devices, monitoring the thrust bearing metal temperature with a thrust bearing metal temperature sensor, determining if the at least one operating parameter relating to the high pressure turbine bowl pressure and the at least one operating parameter relating to the intermediate pressure turbine bowl pressure are within a range of unacceptable risk, and based at least in part upon the step of determining, continuously running back the load reference by adjusting at least one steam valve associated with an inlet pipe upon determining that the at least one operating parameter relating to the high pressure turbine bowl pressure and the at least one operating parameter relating to the intermediate pressure turbine bowl pressure are within a range of unacceptable risk.

14. The system of claim 13, wherein the processor executes additional software instructions for determining a rise in the thrust bearing metal temperature to a temperature range associated with unacceptable risk; and continuously running back the load reference until the thrust bearing metal temperature decreases below the temperature range associated with unacceptable risk.

15. The system of claim 13, wherein the range of unacceptable risk occurs when the high pressure turbine bowl pressure is greater than a predetermined percentage of a rated pressure associated with the high pressure turbine bowl while the intermediate pressure turbine bowl pressure is less than a predetermined percentage of a rated pressure associated with intermediate pressure turbine bowl.

16. The system of claim 13, wherein the processor executes additional software instructions for taking corrective action includes at least one of: setting off an alarm, transmitting an alarm signal, closing the at least one steam valve, altering a temperature of the steam entering the steam turbines, altering a pressure of the steam entering the steam turbines, or shutting the turbine system off altogether.

17. The system of claim 13, wherein the processor executes additional software instructions for recording instances in a memory location associated with the control unit when at least one of the sensor devices detects one or more turbine components operating in a range of unacceptable risk.

* * * * *